US007156184B2

(12) United States Patent
Wagner

(10) Patent No.: US 7,156,184 B2
(45) Date of Patent: Jan. 2, 2007

(54) INERT RENDERING METHOD WITH A NITROGEN BUFFER

(75) Inventor: Ernst Werner Wagner, Winsen/Aller (DE)

(73) Assignee: Wagner Alarm—und Sicherungssysteme GmbH (DE)

( * ) Notice: Subject to any disclaimer, the term of this patent is extended or adjusted under 35 U.S.C. 154(b) by 438 days.

(21) Appl. No.: 10/312,240

(22) PCT Filed: Nov. 12, 2001

(86) PCT No.: PCT/DE01/04245

§ 371 (c)(1),
(2), (4) Date: Dec. 23, 2002

(87) PCT Pub. No.: WO02/055155

PCT Pub. Date: Jul. 18, 2002

(65) Prior Publication Data

US 2003/0226669 A1 Dec. 11, 2003

(30) Foreign Application Priority Data

Jan. 11, 2001 (DE) ..... 101 01 079
May 3, 2001 (DE) ..... 101 21 550

(51) Int. Cl.
*A62C 2/00* (2006.01)

(52) U.S. Cl. ..... 169/45; 169/9; 169/46

(58) Field of Classification Search ..... 169/9, 169/11, 16, 44–47
See application file for complete search history.

(56) References Cited

U.S. PATENT DOCUMENTS 1,839,658 A * 1/1932 Dugas ..... 169/44
2,841,227 A * 7/1958 Betzler ..... 169/77
4,224,994 A * 9/1980 Tone et al. ..... 169/9
4,505,336 A * 3/1985 Thevis et al. ..... 169/85
4,807,706 A * 2/1989 Lambertsen et al. ..... 169/45
6,016,874 A 1/2000 Bennett
6,189,623 B1 * 2/2001 Zhegrov et al. ..... 169/45
6,739,399 B1 * 5/2004 Wagner et al. ..... 169/45

(Continued)

FOREIGN PATENT DOCUMENTS

DE 198 11 851 C2 9/1999

(Continued)

OTHER PUBLICATIONS

Wulf, Vorbeugender Brandschutz durch Permanent-Inertisierung, TÜ 177, Band 41, (2000) Nr. 6-Jun., pp. 20-23.

(Continued)

*Primary Examiner*—Thomas Denion
*Assistant Examiner*—Diem Tran
(74) *Attorney, Agent, or Firm*—Brooks Kushman P.C.

(57) ABSTRACT

The invention relates to an inert rendering method for preventing and/or extinguishing fires in enclosed spaces, wherein an oxygen-inhibiting gas is introduced into the target area in order to adjust a first basic level of inertion with a reduced oxygen content in comparison with natural conditions, and wherein an oxygen-inhibiting gas is further introduced in a gradual or sudden manner (in the case of a fire) into the target area in order to adjust one or more levels of inertion with a similarly reduced oxygen content. The invention also relates to a device for carrying out the method, comprising an oxygen-measuring device in the target area and a source of an oxygen-inhibiting gas. The aim of the invention is to provide an inert rendering method and device for carrying out said method enabling the storage of extinguishing gas needed to extinguish a fire in a simple, economical manner without having to resort to premises which are normally specially provided therefor.

11 Claims, 4 Drawing Sheets

U.S. PATENT DOCUMENTS

| | | | |
|---|---|---|---|
| 2002/0040940 | A1 | 4/2002 | Wagner et al. |
| 2003/0094288 | A1 | 5/2003 | Wagner et al. |

FOREIGN PATENT DOCUMENTS

| | | | |
|---|---|---|---|
| EP | 0301 464 | A2 | 2/1989 |
| EP | 0 700 693 | A1 | 3/1996 |
| EP | 1 062 005 | B1 | 12/2000 |
| RU | 2074758 | C1 | 3/1997 |
| WO | WO 99/47210 | | 2/1999 |
| WO | WO 02/055155 | A1 | 7/2002 |

OTHER PUBLICATIONS

Report of GPTO, Nov. 27, 2001.
Russian Examination Report dated Feb. 2, 2005.

* cited by examiner

| Sauerstoff-Konzentration im Stickstoff-Puffer $K_N$ [Vol.% $O_2$] | Sauerstoff-Konzentration im Raum $K_R$ [Vol.% $O_2$] | Sauerstoff-Konzentration nach Vermischung $K_{RN}$ [Vol.% $O_2$] | Volumen-Verhältnis Puffer/Raum $V_N/V_R$ | Annahme Raumhöhe $H_R$ [m] | ergibt Pufferhöhe $H_N$ [m] |
|---|---|---|---|---|---|
| 5 | 17 | 15 | 0,2 | 4 | 0,8 |
| 5 | 17 | 13 | 0,5 | 4 | 2,0 |
| 5 | 17 | 11 | 1,0 | 4 | 4,0 |
| 5 | 15 | 13 | 0,3 | 4 | 1,0 |
| 5 | 15 | 12 | 0,4 | 4 | 1,7 |
| 5 | 15 | 11 | 0,7 | 4 | 2,7 |
| | | | | | |
| | | | | | |
| $K_N$ [Vol.% $O_2$] | $K_R$ [Vol.% $O_2$] | $K_{RN}$ [Vol.% $O_2$] | $V_N/V_R$ | $H_R$ [m] | $H_N$ [m] |
| 1 | 17 | 15 | 0,1 | 4 | 0,6 |
| 1 | 17 | 13 | 0,3 | 4 | 1,3 |
| 1 | 17 | 11 | 0,6 | 4 | 2,4 |
| 1 | 15 | 13 | 0,2 | 4 | 0,7 |
| 1 | 15 | 12 | 0,3 | 4 | 1,1 |
| 1 | 15 | 11 | 0,4 | 4 | 1,6 |

Fig. 4

INERT RENDERING METHOD WITH A NITROGEN BUFFER

BACKGROUND OF THE INVENTION

1. Field of the Invention

The invention relates to an inert rendering method for preventing and/or extinguishing fires in an enclosed space (hereinafter also called the "target area"), wherein an oxygen-inhibiting gas is introduced into the target area in order to adjust a first basic level of inertion with a reduced oxygen content in comparison with natural conditions, and wherein an oxygen-inhibiting gas is further introduced in a gradual or sudden manner (in the case of a fire) into the target area in order to adjust one or more levels of inertion with a similarly reduced oxygen content. The invention relates also to a device for carrying out the method with an oxygen-measuring device in the target area and a source of an oxygen-inhibiting gas.

2. Background Art

The method and device of the kind in question are familiar in the state of the art. The effect of the so-called "inert gas extinguishing method" is mainly based on the fact that in enclosed spaces, which are only occasionally accessed by human beings or animals and the equipment of the spaces would suffer considerable damage if traditional extinguishing methods (water and foam) were applied, the fire hazard is averted by reducing the oxygen concentration in the area concerned to an average value of approximately 12 per cent by volume, at which most flammable materials no longer burn. Realms of application are electronic data processing areas, electrical control and distributing rooms, or storage areas containing high-grade goods. The extinguishing effect is based on the principle of oxygen displacement. Normal ambient air is composed of 21% oxygen, 78% nitrogen and 1% other gases. For fire extinguishing, for example, the concentration of nitrogen in the target area is further increased by introducing pure nitrogen, thus reducing the oxygen content. It is common knowledge that an extinguishing effect takes place when the oxygen content drops below a value of 15 per cent by volume. Depending on the materials stored in the particular area, a further lowering of the oxygen content to the above-mentioned 12 per cent by volume or lower may be required.

Normally, gases such as carbon dioxide, nitrogen, inert gases and mixtures thereof are used as oxygen-inhibiting gases, which are usually stored in steel cylinders in special adjacent areas. In order to flood a target area with extinguishing gas, it has been necessary up to now to store a considerable quantity of extinguishing gas, particularly for commercially used premises, such as open-plan offices and warehouses. Since the pressure of the gas cylinders is limited due to the ultimate load of the available fittings, and also since the volumetric capacity cannot be increased as desired, a considerable number of cylinders are required to make the extinguishing gases available. This fact, together with the required gas pipes and fittings, makes great demands on the ultimate load capacity and size of the storage areas. Even if the cylinders were stored in the basement, considerable structural input would be required to lay the supply lines to the target areas. In addition, correspondingly large storage areas will result in increased building and operating costs.

SUMMARY OF THE INVENTION

The latest developments have shown that this problem can be solved by lowering the oxygen content in the target areas to an average basic level of inertion of approximately 17 per cent by volume, which is harmless for living beings. In doing so, the quantity of extinguishing gas needed, in order to reach the full level of inertion at an oxygen concentration of below 15 per cent by volume to prevent or extinguish fires, will be reduced. This constitutes an improvement of the described storage problems. Nevertheless, it is still necessary to make structural provisions for special premises that are suited to the storage of steel cylinders on account of their load capacity and size. Especially in view of the trend of providing increasingly larger structures, this leads to considerable financial costs in the construction phase, as well as in usage.

The aim of the invention is to provide an inert rendering method and device for carrying out said method, enabling the storage of extinguishing gas needed to extinguish a fire in a simple, economical manner without having to resort to premises which are normally specially provided therefor.

This problem is solved by the inert rendering method, wherein in a first step a), a buffer gas volume is generated in an enclosed buffer space, which is connected to the target area via supply lines, by introducing an oxygen-inhibiting gas. The oxygen content of the buffer gas volume is so low that, by mixing the buffer gas volume with the ambient air in the target area, a full level of inertion for extinguishing purposes can be reached. In a second step b), the buffer gas volume is guided, in case of need, via supply lines into the target area where, by mixing the ambient air of the target area with the buffer gas volume, the latter is used to adjust a level of inertion that differs from the first basic level of inertion.

BRIEF DESCRIPTION OF THE DRAWINGS

FIG. 4 shows a table with the various volume ratios (V) and spatial heights (H) of the buffer space and the target area depending on the oxygen concentrations (K) that are present therein, respectively, before and after the mixing.

The same reference numbers are used hereunder for identical parts or parts with the same effect.

DETAILED DESCRIPTION OF THE PREFERRED EMBODIMENTS

Figure 1:
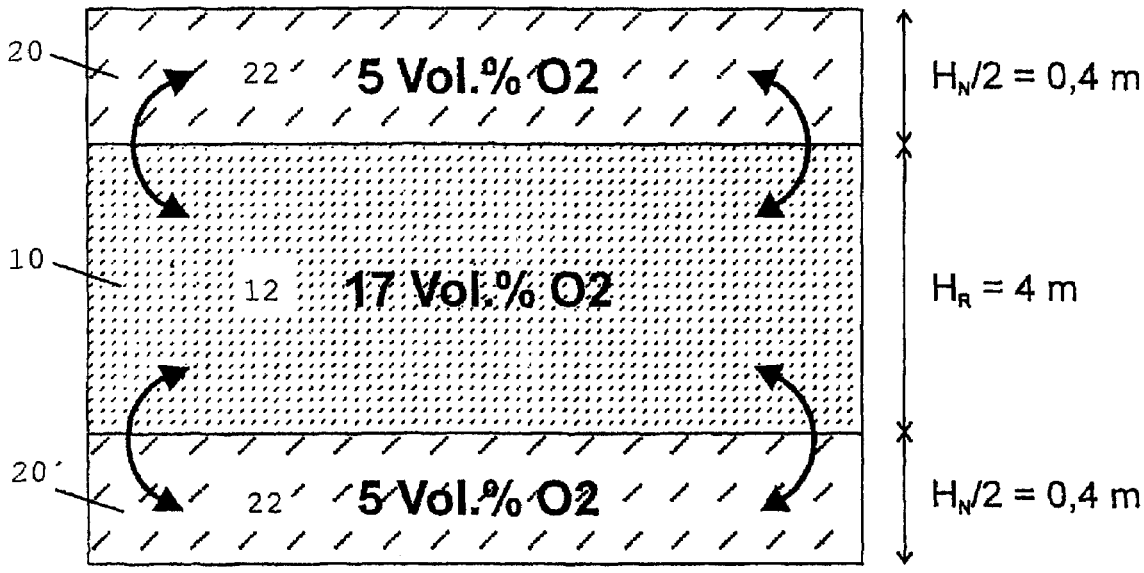
FIG. 1 is a schematic representation of an area with buffer rooms (20, 20') and a target area (10) prior to mixing the buffer gas volume(22, 22') with the ambient air (12)

The invention starts out by taking into consideration the storage of extinguishing gas, which is problematic because it is stored under pressure in special containers, such as steel cylinders, which, on account of their weight and for safety reasons, require special premises. Considering, on the other hand, the predominant concept of new structures, primarily in the commercial sector, one finds that a substantial portion of the premises has already been separated for purposes other than the actual use of the premises by human beings and/or animals. However, only a small portion of said premises is equipped with installations, such as, for example, air-conditioning plants, lighting and cable chutes. By adjusting a basic level of inertion of an oxygen content averaging approximately 17 per cent by volume closely to a full level of inertion of less than 15 per cent by volume, it is possible to have in the target areas the quantity of necessary extinguishing gas also without condensation, provided there is a corresponding buffer space. Such a buffer space can be created in parts of the premises such as, for example, intermediate ceilings, double floors, partitions or adjoining technical areas. The walls of the buffer space can be solid partitions or sheeting. The oxygen content of the buffer gas volume present in the buffer space, which is adjusted in the first step a) of the introduced method, is so small that, after mixing the buffer gas volume with the ambient air of the target area, which is kept at a basic level of inertion of an oxygen concentration averaging approximately 17 per cent by volume, a full level of inertion is adjusted in the entire area, which is below an oxygen concentration of 15 per cent by volume to prevent and/or extinguish fires.

However, certain volume and oxygen concentration ratios between the buffer space and the target area must be observed . These can be ascertained from the following calculations:

$V_N$—is the volume of the buffer space $V_R$—is the volume of the target area $V_{RN}$—is the volume of the total area and $K_N$—is the oxygen concentration in the buffer space $K_R$—is the oxygen concentration in the target area $K_{NR}$—is the oxygen concentration in the total area From the basic equation of the volume and concentration ratios for the total of the buffer space and target area before and after the mixture $$V_N \cdot K_N + V_R \cdot K_R \approx V_{NR} \cdot K_{RN} \quad (1)$$

the following results in $$V_{NR} \approx V_N + V_R \quad (2)$$

and $$V \approx A \cdot H \quad (3)$$

wherein

V—is the volume of a space

A—is the floor space of an area

H—is the height of a space by applying equation (2) to equation (1) and resolving according to $V_N/V_R$ $$V_N/V_R \approx (K_{NR} - K_R)/(K_N - K_{NR}) \quad (4)$$

and finally by applying equation (3) to (4)

$$H_N/H_R \approx (K_{NR} - K_R)/(K_N - K_{NR}) \quad (5).$$

Thus, equation (5) indicates the necessary height ratio $H_N/H_R$ between the buffer space and the target area, if the following are specified: a certain oxygen concentration $K_{NR}$ as full inertion level, a basic inertion level $K_R$ in the target area, and an oxygen concentration $K_N$ in the buffer space. Conversely, the necessary oxygen concentrations can, of course, be concluded from a specified $H_N/H_R$ ratio.

A special advantage of the method, according to the invention, is that a second basic level of inertion with an oxygen content that is similarly reduced and which is different from the first basic level of inertion, or is the full level of inertion, can be adjusted for extinguishing operations. Thus, the method is adaptable to the largest extent to the existing use of a building. If, for example, a complex of buildings is not used or accessed during the night by living beings, it is possible, by lowering the basic level of inertion for daytime operation with an oxygen concentration of, for example, 17 per cent by volume to a basic level of inertion for nighttime operation with an oxygen concentration of, for example 15 per cent by volume, to reach the full level of inertion for the extinguishing operation with an oxygen concentration below 15 per cent by volume, by supplying a respective quantity of oxygen-inhibiting gas from the buffer space, and thereby achieve an extinguishing effect very quickly. Naturally, it is also possible to adjust the second basic level of inertion for nighttime operation, as a fire prevention measure, and, in case of need, for extinguishing fires on weekends or holidays on or during which a building is not used.

A possible fire is advantageously prevented or, however, extinguished owing to a fire detection signal, if the ambient air of the target area is mixed with the buffer gas volume in such a way that an average oxygen concentration between 8 and 17 per cent by volume occurs in the target area on account of the specified quantity and concentration ratios of oxygen in both areas. This can be accomplished in such a way that a basic level of inertion of, for example, 17 per cent by volume is set first of all for daytime operation. Said level is harmless for living beings who are present there. For nighttime operation, a further reduced basic level of inertion of, for example, 15 per cent by volume is set in a second step. Starting out from said level, the full level of inertion of, for example, 11 per cent by volume is easily reached through the fast supply of an oxygen-inhibiting gas from the buffer gas volume into the target area. Thus, fires are prevented from developing by adjusting the basic level of inertion for daytime operation. The oxygen concentration drops to the basic level of inertion for nighttime operation and, in case of fire, it drops to the full level of inertion at which most of the materials used on supervised premises are no longer flammable.

Especially advantageous is an oxygen content of the buffer volume of 10 per cent by volume or less. This concentration provides adequate security against possible leakage from the buffer space. It can be reached by a respective aggregate and provides the most efficient lowering effect of the basic level of inertion to the full level of inertion by mixing the buffer gas volume with ambient air.

The buffer gas volume is preferably composed of pure inert gas. Thus, an especially great potential of an oxygen-inhibiting gas for the maximum lowering of the oxygen content of the air in the target area is available, particularly for the supervision of premises with highly flammable materials.

In a feasible embodiment it is possible, in case of need, to guide the buffer gas volume or buffer gas volumes of buffers of another area or areas to the target area via a supply line. The advantage of this embodiment is that in cases in which several areas of a building are equipped with one buffer, respectively, the inert gas from all buffers can be used in order to extinguish the fire in one of the areas (target area). Thus, even in those areas whose inherent buffer gas volumes are only dimensioned to adjust the respective basic level of inertion, it is possible to adjust the full level of inertion. The result is that effective fire fighting is possible even in such areas.

The problem facing this invention is also solved by a device for carrying out the described method by way of an enclosed buffer space that adjoins the target area and is connected to the latter via gas supply lines. A buffer gas volume is generated in the buffer space by introducing an oxygen-inhibiting gas. The oxygen content of the buffer gas volume is so low that, by mixing the buffer gas volume with the ambient air in the target room, a full level of inertion for the extinguishing operation can be achieved.

It possible to control the basic inertion of the target area from the buffer space via the supply lines, as well as to establish a quick, full inertion of the target area.

Naturally, it is also conceivable for a buffer space to supply several adjoining target areas.

A special flexibility of the device, according to the invention, is achieved in that a second basic level of inertion with a similarly reduced oxygen content, which is different from the first basic level of inertion, or is the full level of inertion, can be adjusted for extinguishing operations. Such a second basic level of inertion, which is usually so close to the full level of inertion that fire prevention in an enclosed space is rendered possible, can be adjusted accordingly on weekends or holidays on or during which a building is not used. Thus, in case of need, the full level of inertion for extinguishing fires is quickly reached by supplying an oxygen-inhibiting gas from the buffer space.

The buffer space is preferably designed as a container, particularly as a tank. In doing so, possible leaks, which may exist when using structurally specified premises for storing buffer gas, are excluded from the start. The container can be constructed in such a way that use is made of the available free space in intermediate ceilings or partitions, and the container is placed optimally therein.

In a possible embodiment, the respective buffer spaces of the rooms of a building are connected to the individual areas via gas supply lines. Thus, in case of need, the buffer gas volume or buffer gas volumes can be guided by buffers of another area or areas into the target area via such supply lines. The prerequisite for this is that several areas of a building be equipped with one buffer, respectively. The advantage of this embodiment is that, even in those cases in which the respective buffer gas volumes are only dimensioned to adjust the basic level of inertion for the individual area, the full level of inertion can be reached in the target area in order to extinguish a fire.

Areas, the inherent buffer gas volumes of which are only dimensioned to adjust the respective basic level of inertion, are connected advantageously, via traps or valves, with supply lines to buffer spaces of the other areas, respectively. Thus, in case of fire the supply of a target area with buffer gas volumes of other buffer areas can be controlled and readjusted upon reaching the full level of inertion in the target area. This will ensure, among other things, that the fire in the target area is extinguished efficiently and as quickly as possible.

In order for the buffer gas volume to mix quickly with the ambient air, a mixing unit has been advantageously provided for mixing the ambient air of the target area with the buffer gas volume. Thus, in case of fire, mixing can be accomplished quickly in order to reach the full level of inertion in the target area. However, it is also conceivable that the basic level of inertion in the target area be controlled from the buffer space.

Providing the mixing unit with ventilation flaps and ventilators that are arranged in or at the target area is advantageous. If the ventilation flaps are closed, this particularly simple design allows for a largely gas-tight seal of the buffer space in relation to the target area. If the ventilation flaps are fully or partially open, a controlled flooding of the target area is possible.

A control unit for regulating the oxygen content in the target area, with a signal transmitter for switching from daytime operation to nighttime operation, has been advantageously provided. Such a control unit allows the level of inertion to be adapted to the operating state, as desired at the time. The signal transmitter can perform the desired switching between daytime and nighttime operation independently of manual action and, therefore, without requiring operating personnel.

According to a possible realization, the control unit would also monitor the air quality of the ambient air, by measuring the CO or $CO_2$ content, and activate the ventilation flaps or the ventilators to supply fresh air. The advantage of this embodiment is that no additional device for controlling the air quality of the ambient air is required.

The signal transmitter can be advantageously designed in such a way that it transmits a timing signal, a burglar alarm signal or an access control signal. If, for example, a timing device is used as signal transmitter, it is possible to preprogram an automatic change-over from daytime to nighttime operation. This kind of presetting can also be carried out for days on which no work is performed, as for example, on week-ends on which usually no people are on the premises that are to be monitored, and on which it is appropriate to adjust the basic level of inertion below that for daytime operation in order to prevent fires. However, the signal transmitter can also be constructed as an access control gear which, when identifying persons who show proof of identity via a code or a magnetic card, transmits a signal to the control, which then sets a level of inertion that is harmless for living beings. When using a burglar alarm system as signal transmitter, a change-over to full inertion would be conceivable if an area were sharply switched after all persons present have left it.

It is ensured in an advantageous manner by a fire detector, for example, an automatic smoke or heat detector or a portable fire detector for triggering the mixing of the buffer gas volume with the ambient air in the target area for extinguishing operations, that a fire can be reliably detected and extinguished at any time. In addition, such a fire detector can also trigger an acoustic and/or visual warning function for persons in the area concerned. At the same time, it is also possible to couple the fire detector with fire-protection doors which, upon the triggering of the mixing of the buffer gas volume with the ambient air of the area concerned, close automatically and separate such area from other spaces.

The invention is further described below, based on embodiments that are explained in detail with the help of illustrations.

FIG. 1 shows a schematic representation of an area with buffer spaces (20, 20') and a target area (10) prior to mixing the buffer volume (22, 22') and the ambient air (12). The buffer space contains a buffer gas volume with an oxygen content of 5 per cent by volume, respectively. The target area contains ambient air with an oxygen concentration at a basic level of inertion of 17 per cent by volume. The heights (H) of the buffer spaces (20, 20') are indicated laterally.

Figure 2:
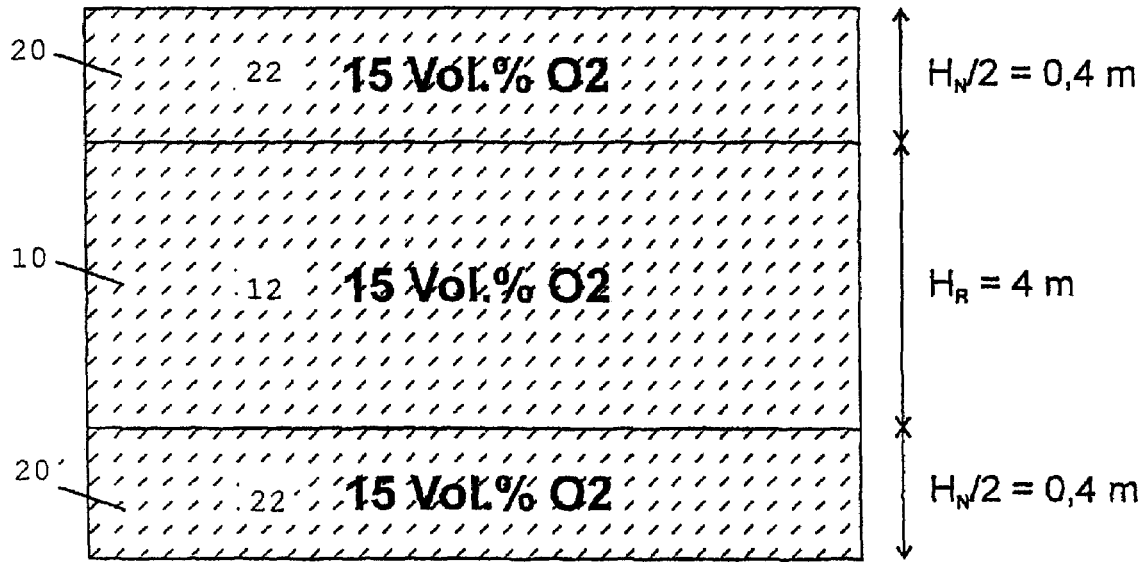
FIG. 2 is the same schematic representation as shown in FIG. 1, after mixing the buffer gas volume (22, 22') with the ambient air (12)

FIG. 2 shows the same schematic representation as FIG. 1, after mixing the buffer gas volume (22, 22') with the ambient air (12). Due to the height and concentration ratios, an oxygen concentration at full level of inertion of 15 per cent by volume, according to equation (5), occurs throughout the entire space. This can occur during nighttime operation in order to prevent fires, as well as being the result of a fire-detection signal.

Figure 3:
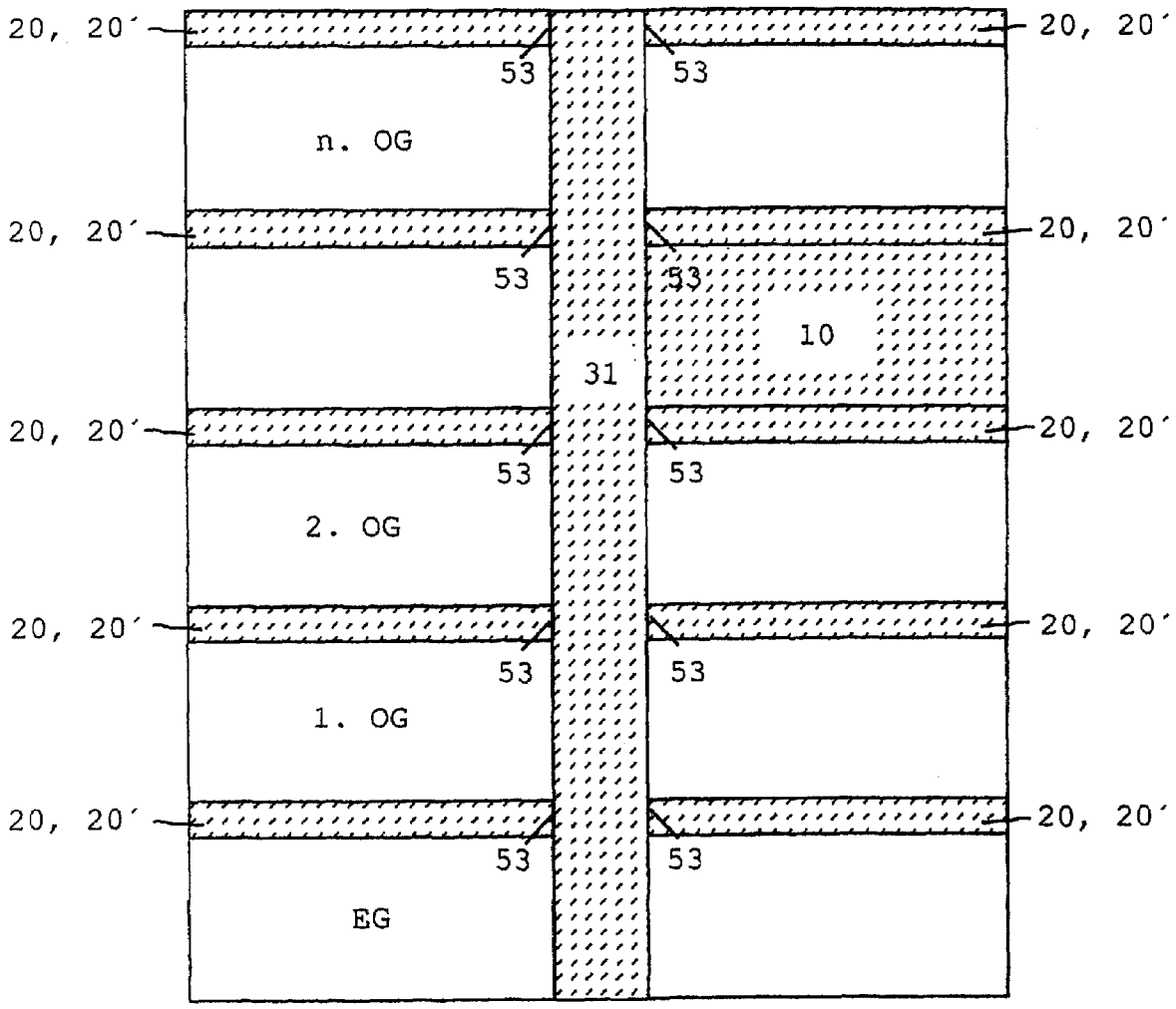
FIG. 3 is a schematic representation of a building with several buffer spaces (20, 20') connected to one another by a supply line (31)

FIG. 3 shows a schematic representation of a building with several buffer spaces (20, 20') that are connected to one another by a supply line (31). In the example, the individual areas of the building are only dimensioned with buffer gas volumes to adjust a basic level of inertion. The individual buffer spaces (20, 20') are connected to the supply line (31) via traps or valves (53). Thus, in case of fire, the target area (10) can be additionally supplied with buffer gas volumes (22, 22') from other buffer spaces (20', 20'), and a full level of inertion can be adjusted in the target area (10). As a result, firefighting in the target area (10) can also be accomplished quickly and efficiently.

FIG. 4 shows a table with various volume ratios (V) and spatial heights (H) of the buffer space and the target area, depending on the oxygen concentrations (K) found therein, respectively, before and after the mixing. Starting out from the various oxygen concentrations in the buffer space and in the target area, varying full levels of inertion ranging between 11 and 15 per cent by volume are reached in the height and volume ratios. This allows the necessary concentration and volume ratios to be co-ordinated with the flammable materials present mainly in the areas used.

Figure 5:
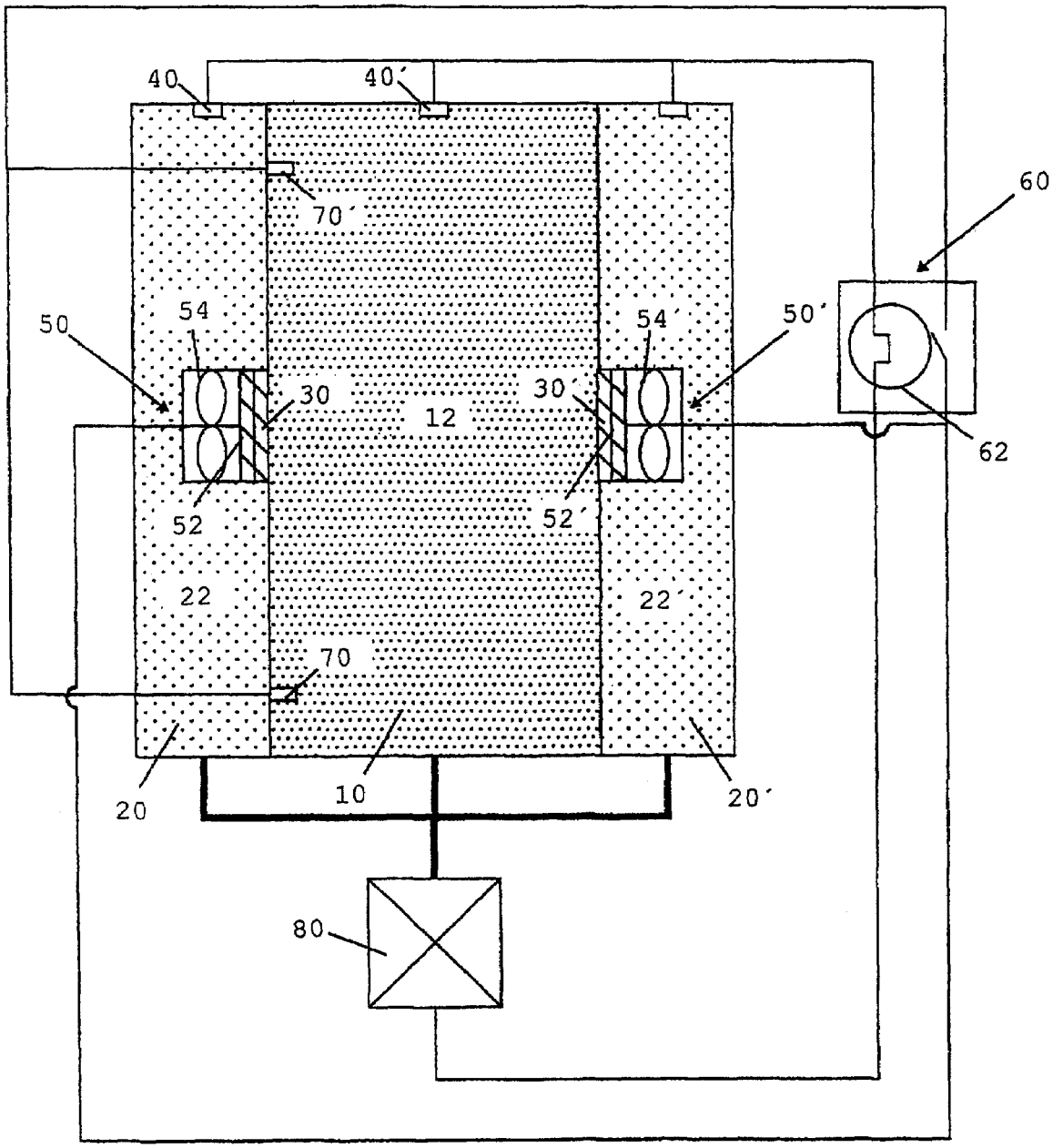
FIG. 5 shows an operational diagram of a device for carrying out the method, according to the invention.

FIG. 5 shows an operational diagram of a device for carrying out the method, according to the invention. A buffer space (20, 20') and a target area (10) can be seen on this diagram. The buffer and target areas are connected to one another by supply lines (30, 30'), which have been provided with mixing units (50', 50'), consisting of ventilators (54, 54') and ventilation flaps (52, 52'). In this design, a generator (80) supplies the buffer as well as the target area with nitrogen in order to adjust a specified oxygen concentration in the buffer gas volume (22, 22') and in the ambient air (12). The oxygen concentration is recorded with the help of the oxygen measuring device (40, 40') and passed on as a signal to a control unit (60). The control unit in turn activates the generator (80) via a signal line. The control unit (60) comprises a timer (62) that can switch the generator to nighttime or daytime operation via another signal line. The generator (80) then establishes the desired level in the buffer space (20, 20') and in the target area (10) by increasing or decreasing the supply of nitrogen. Thus, fire is prevented from developing right from the outset. It is also possible to trigger, via fire detectors (70, 70'), the mixing units (60, 61') directly by way of the control unit (62) that activates the mixing units in case of fire.

It should be pointed out here that all of the above-described parts, seen either individually or in any combination, especially the details shown on the drawings, are claimed as being essential to the invention. The expert is familiar with the modifications thereof.

The invention claimed is:

1. A device for carrying out an inert rendering method for at least one of preventing and extinguishing fires in an enclosed target area wherein an oxygen-inhibiting gas is introduced into the target area in order to create a first basic level of inertion with a reduced oxygen content in comparison with natural conditions, and wherein an oxygen-inhibiting gas is further introduced in a gradual or sudden manner (in the case of a fire) into the target area in order to create one or more levels of inertion with a further reduced oxygen content, the inert rendering method comprising the steps of:

a) generating a buffer gas volume by introducing an oxygen-inhibiting gas in at least one enclosed buffer space which is connected to the target area via supply lines, wherein the oxygen content of the buffer gas volume is so low when the buffer gas volume mixes with the ambient air in the target area, that a level of inertion with a further reduced oxygen content is reached; and b) guiding the buffer gas volume via the supply lines into the target area, where it is used by mixing the ambient air of the target area, thereby providing the first basic level of inertion with the buffer gas volume to create a level of inertion that differs from the first basic level of inertion, the device comprising an oxygen measuring device positioned in a target area;

a source of an oxygen-inhibiting gas;

an enclosed buffer space that is connected to the target area via gas supply lines in which, by introducing an oxygen-inhibiting gas, a buffer gas volume is generated whose oxygen content is low, so that when mixing the buffer gas volume with the ambient air in the target area, a full level of inertion for an extinguishing operation can be reached; and a mixing unit for mixing the ambient air of the target area with the buffer gas volume.

2. A device according to claim 1, wherein the level of inertion, which differs from a level of inertion created in step (a), is a second basic level of inertion with a reduced oxygen content.

3. A device according to claim 1, wherein the level of inertion, which differs from a level of inertion created in step (a), is a second basic level of inertion with a full level of inertion for the fire extinguishing operation.

4. A device according to claim 1, wherein the buffer space is a container.

5. A device according to claim 1, wherein the gas supply line connects the enclosed buffer spaces of the individual areas of a building so that the buffer gas volumes of the individual areas are guided into the target area.

6. A device according to claim 1, further including:

a valve unit connected between the supply line and buffer rooms of the individual areas of a building.

7. A device according to claim 1, wherein the mixing unit contains ventilation flaps and ventilators that are arranged proximate to the target area.

8. A device according to claim 1, further comprising:

a fire detector for triggering the mixing of the buffer gas volume with the ambient air of the target area in the fire extinguishing operation.

9. A device according to claim 1, further comprising:

a control unit for regulating the oxygen content in the target area and a signal transmitter for switching from a first basic level of inertion to one or more, different basic levels of inertion.

10. A device according to claim 9, wherein the control unit also monitors the air quality of the ambient air by measuring at least one of the CO and $CO_2$ content, and wherein the control unit activates at least one of the ventilation flaps and ventilators for the supply of fresh air.

11. A device according to claim 9, wherein the signal transmitter generates a signal selected from the group consisting of: a timing signal, a burglar alarm signal and an access control signal.

* * * * *